US008735709B2

(12) United States Patent
Yamauchi et al.

(10) Patent No.: US 8,735,709 B2
(45) Date of Patent: May 27, 2014

(54) GENERATION OF HARMONY TONE

(75) Inventors: Akira Yamauchi, Hamamatsu (JP); Hikaru Kase, Hamamatsu (JP); Motoaki Takashima, Nagoya (JP)

(73) Assignee: Yamaha Corporation (JP)

( * ) Notice: Subject to any disclaimer, the term of this patent is extended or adjusted under 35 U.S.C. 154(b) by 439 days.

(21) Appl. No.: 13/033,670

(22) Filed: Feb. 24, 2011

(65) Prior Publication Data

US 2011/0203444 A1 Aug. 25, 2011

(30) Foreign Application Priority Data

Feb. 25, 2010 (JP) ..... 2010-040068
Feb. 14, 2011 (JP) ..... 2011-028622

(51) Int. Cl.
*G10H 1/00* (2006.01)

(52) U.S. Cl.
USPC ..... 84/616; 84/609; 84/615; 84/622; 84/649; 84/653; 84/654; 84/659

(58) Field of Classification Search
None
See application file for complete search history.

(56) References Cited

U.S. PATENT DOCUMENTS 4,429,609 A * 2/1984 Warrender ..... 84/454
4,991,484 A * 2/1991 Kawashima ..... 84/603
5,231,671 A 7/1993 Gibson et al.
5,446,238 A 8/1995 Koyama et al.
5,969,282 A * 10/1999 Berners et al. ..... 84/603
5,973,252 A * 10/1999 Hildebrand ..... 84/603
RE37,041 E 2/2001 Koyama et al.
6,307,140 B1 * 10/2001 Iwamoto ..... 84/622
6,816,833 B1 * 11/2004 Ito et al. ..... 704/207
8,035,020 B2 * 10/2011 Taub et al. ..... 84/600
8,258,391 B2 * 9/2012 Taub et al. ..... 84/616
2001/0037196 A1 11/2001 Iwamoto
2010/0307321 A1 * 12/2010 Mann et al. ..... 84/613
2011/0088534 A1 * 4/2011 Takashima ..... 84/622
2011/0232461 A1 * 9/2011 Taub et al. ..... 84/609

FOREIGN PATENT DOCUMENTS

EP 0913808 A1 5/1999
EP 1065651 A1 1/2001
JP 6-202660 A 7/1994
JP 2879948 B2 4/1999

OTHER PUBLICATIONS

Extended European Search Report for corresponding EP 11155780.7, dated Feb. 1, 2012.

* cited by examiner

*Primary Examiner* — Marlon Fletcher
(74) *Attorney, Agent, or Firm* — Rossi, Kimms & McDowell, LLP

(57) ABSTRACT

A lead tone is generated on the basis of an input tone signal. Meanwhile, a specific pitch of the input tone signal is sequentially detected, from which is detected a normalized pitch corresponding to any one of the musical pitch names. Then, difference information is obtained which pertains to a difference between the specific pitch and the normalized pitch, and a pitch having a given pitch interval from the normalized pitch is determined as a target pitch of a tone signal to be generated. Then, a harmony tone is generated which has a pitch obtained by modulating the target pitch in accordance with the difference information.

24 Claims, 11 Drawing Sheets

C MAJOR CHORD HARMONY TABLE

| INPUT TONE PITCH | HARMONY GROUP 1 TARGET PITCH |
|---|---|
| C | E |
| C# | E |
| D | G |
| D# | G |
| E | G |
| F | C+ |
| F# | C+ |
| G | C+ |
| G# | C+ |
| A | C+ |
| A# | E+ |
| B | E+ |

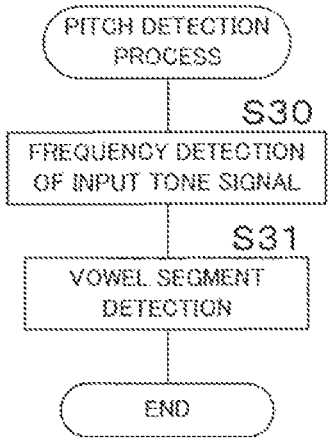

FIG. 6

C MAJOR CHORD HARMONY TABLE

| INPUT TONE PITCH | HARMONY TARGET PITCH | | |
|---|---|---|---|
| C | E | G | C+1 |
| C# | E | G | C+1 |
| D | G | C+1 | E+1 |
| D# | G | C+1 | E+1 |
| E | G | C+1 | E+1 |
| F | C+1 | E+1 | G+1 |
| F# | C+1 | E+1 | G+1 |
| G | C+1 | E+1 | G+1 |
| G# | C+1 | E+1 | G+1 |
| A | C+1 | E+1 | G+1 |
| A# | E+1 | G+1 | C+2 |
| B | E+1 | G+1 | C+2 |

FIG. 7A

C MINOR CHORD HARMONY TABLE

| INPUT TONE PITCH | HARMONY TARGET PITCH | | |
|---|---|---|---|
| C | D# | G | C+1 |
| C# | D# | G | C+1 |
| D | G | C+1 | D#+1 |
| D# | G | C+1 | D#+1 |
| E | G | C+1 | D#+1 |
| F | C+1 | D#+1 | G+1 |
| F# | C+1 | D#+1 | G+1 |
| G | C+1 | D#+1 | G+1 |
| G# | C+1 | D#+1 | G+1 |
| A | C+1 | D#+1 | G+1 |
| A# | D#+1 | G+1 | C+2 |
| B | D#+1 | G+1 | C+2 |

FIG. 7B

HARMONY-TONE-SPECIFIC PITCH DIFFERENCE ADDING RATIO TABLE

| HARMONY TONE | PITCH DIFFERENCE ADDING RATIO (%) |
|---|---|
| 1 | 20 |
| 2 | 25 |
| 3 | 15 |
| ⋮ | |

FIG. 8A

LEVEL-SPECIFIC PITCH DIFFERENCE ADDING RATIO TABLE

| LEVEL | PITCH DIFFERENCE ADDING RATIO (%) |
|---|---|
| GREAT | 30 |
| MEDIUM | 15 |
| SMALL | 5 |
| ZERO | 0 |

FIG. 8B

GENERATION OF HARMONY TONE

BACKGROUND

The present invention relates to a tone signal generation apparatus and method which generate one or a plurality of harmony tone signals by pitch-shifting an input tone signal, and more particularly to a technique for reflecting pitch variation, contained in an input tone signal, in a harmony tone signal as desired. The tone signal generation apparatus and method of the present invention is suited for use in a human voice or musical instrument tone processing system belonging to or attached to music-related equipment, such as a karaoke apparatus, an electronic musical instrument, an effector or a personal computer.

Heretofore, there have been known electronic music apparatus and programs which, on the basis of an input tone signal such as a tone signal of a performance tone of a musical instrument or human voice input by a user via a microphone or the like, can automatically generate one or a plurality of harmony tone signals of pitches (i.e., tone pitches) higher or lower by a predetermined pitch interval, such as three and five degrees, than the tone pitch of the input tone signal and can reproduce the thus-generated harmony tone signals together with the input tone signal to thereby simultaneously audibly generate a lead tone (i.e., input tone) and harmony tones (i.e., additional tones). Examples of such electronic music apparatus are disclosed in Japanese Patent No. 2,879,948 (which will hereinafter be referred to as "patent literature 1") and Japanese Patent Application Laid-open Publication No. HEI-6-202660 (which will hereinafter be hereinafter referred to as "patent literature 2").

In the conventionally-known apparatus disclosed in patent literature 1 and patent literature 2, a tone pitch corresponding to a fundamental frequency, and hence any one of the pitch names, is identified per predetermined segment (or per predetermined time period) on the basis of frequency (tone pitch) information obtained through frequency analysis of an input tone signal. Then, the input tone signal (more specifically, waveform factor data of one period cut out using a window function corresponding to the identified tone pitch) is subjected to a pitch shift process (i.e., is pitch-shifted) in accordance with predetermined pitch shift amounts determined in accordance with the identified tone pitches of the input tone signal, so that one or a plurality of harmony tone signals of predetermined target tone pitches (each corresponding to any one of musical pitch names) are generated separately as independent additional tones. Further, patent literature 2 discloses that, as a tone generated in response to key depression or key-depressed tone (i.e., input tone signal) is bent up in pitch, i.e. a pitch bend value (also referred to as pitch shift amount) is changed in response to user's operation of a wheel, the electric music apparatus corrects pitch bend amounts of additional tones (corresponding to harmony tone signals) so that the additional tones are set at tone pitches that match up with a chord.

However, each harmony tone signal generated in the conventionally-known apparatus as disclosed in patent literature 1 and patent literature 2 is merely of a tone pitch, determined in in semi tones, which corresponds to any one of the musical pitch names and which is always constant; namely, the generated harmony tone signal does not have minute tone pitch variation less than a semi tone (100 cents). Therefore, a musical expression of each of the generated harmony tone signals would undesirably become mechanical. Particularly, in a case where an input tone signal has tone pitch variation, there can occur a great difference between a rich musical expression of a lead tone (input tone) and a mechanical expression of harmony tones (additional tones), so that a user would easily have an uncomfortable feeling. Therefore, there has been a great demand for an improved electronic music apparatus capable of generating a harmony tone signal reflecting therein minute tone pitch variation contained in an input tone signal, but no such electronic music apparatus has been realized or proposed so far.

Further, in order to generate a harmony tone having mere pitch variation (i.e., pitch variation that does not reflect therein pitch variation of an input tone signal), it is only necessary to perform pitch control on a harmony tone signal of a constant tone pitch, for example, for imparting, for example, a vibrato to the harmony tone signal. Note that, in order to ultimately generate a harmony matching a taste of a user, such as a harmony stable and easy to listen as a whole with pitch variation of its lower-pitched tone smaller than pitch variation of its higher-pitched tone, a harmony clearly presenting a feeling, such as like a major or minor feeling, corresponding to a melody or tune or a harmony with a tense feeling made strong and weak through adjustment of pitch variation of a tension note, there is a need to generate a plurality of harmony tones having different pitch variation. However, for generating a plurality of harmony tones having different pitch variation by use of the conventionally-known technique, it is necessary for a user to make parameter settings for vibrato control etc. for each of the harmony tones to be generated, and such parameter setting operation is extremely cumbersome to the user. Therefore, there has been a great demand for an improved tone signal generation apparatus and method capable of generating one or a plurality of harmony tone signals each reflecting therein pitch variation, contained in an input tone signal, at a desired level, but no such tone signal generation apparatus and method have been realized or proposed so far.

SUMMARY OF THE INVENTION

In view of the foregoing, it is an object of the present invention to provide an improved tone signal generation apparatus and method which allow minute pitch variation less than a semi tone contained in an input tone signal to be reflected in a harmony tone signal automatically generated on the basis of the input tone signal.

In order to accomplish the above-mentioned object, the present invention provides a tone signal generation apparatus, which comprises: an input section which inputs a tone signal; a pitch detection section which sequentially detects a specific pitch of the tone signal inputted via the input section and detects, from the specific pitch, a normalized pitch corresponding to any one of pitch names; a difference generation section which obtains difference information pertaining to a difference between the specific pitch and the normalized pitch; a target pitch determination section which determines, as a target pitch of a tone signal to be generated, a pitch having a given pitch interval from the normalized pitch; and a tone signal generation section which generates a tone signal having a pitch obtained by modulating the target pitch in accordance with the difference information.

Because the difference information indicates pitch variation (pitch variation component) contained in the input tone signal, the tone signal generation apparatus of the present invention can generate a harmony tone signal, reflecting therein the pitch variation contained in the input tone signal, by generating a tone signal (harmony tone) having a pitch obtained by modulating the target pitch in accordance with the difference information.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIG. 6 is a flow chart showing an example of frequency detection process performed in the first embodiment;

FIGS. 7A and 7B are diagrams showing example data formats of harmony tables employed in a second embodiment of the tone signal generation apparatus (electronic music apparatus) of the present invention;

FIGS. 8A and 8B are diagrams show example data formats of pitch difference adding ratio tables employed in the second embodiment;

DETAILED DESCRIPTION

Figures 1, 2:
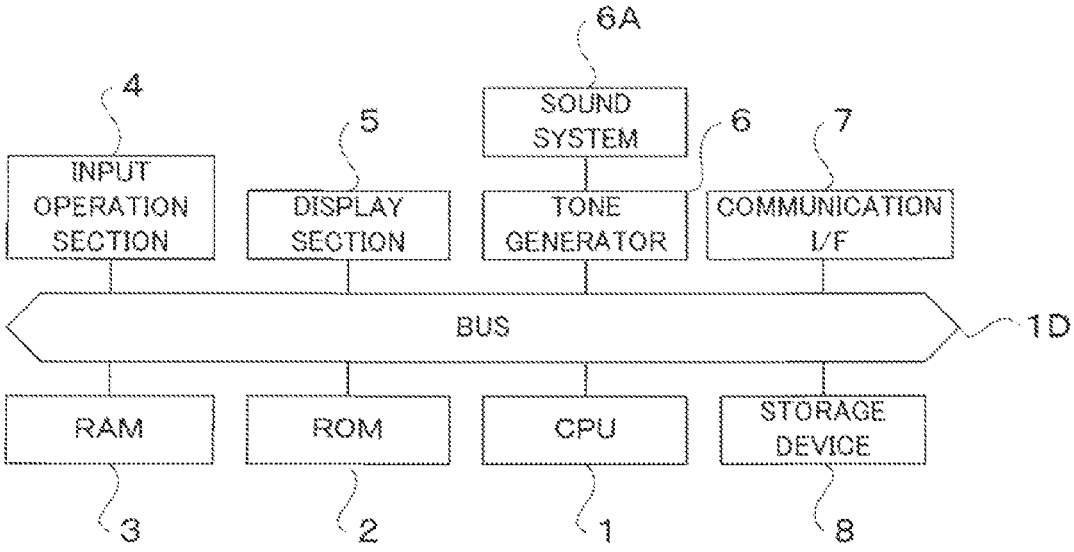
FIG. 1 is a block diagram showing an example general hardware setup of a first embodiment of a tone signal generation apparatus (electronic, music apparatus) of the present invention.
FIG. 2 is a conceptual diagram showing a data format of a harmony table employed in the first embodiment.

FIG. 1 is a block diagram showing an example general hardware setup of a first embodiment of a tone signal generation apparatus (or electronic music apparatus) of the present invention. The first embodiment of the electronic music apparatus is controlled by a microcomputer that includes a microprocessor unit (CPU) 1, a read-only memory (ROM) 2 and a random access memory (RAM) 3. The CPU 1 controls operation of the entire electronic music apparatus. To the CPU 1 are connected, via a data and address bus 1D, the ROM 2, RAM 3, an input operation section 4, a display section 5, a tone generator 6, a communication interface (IF) 7 and a storage device 8.

The ROM 2 stores therein various control programs for execution by the CPU 1 and various data etc., such as harmony tables (tone pitch determination tables) shown in FIG. 2, for reference by the CPU 1. The RAM 3 is used as a working memory for the CPU 1 to temporarily store various data etc. generated as the CPU 1 executes a predetermined program, as a memory for temporarily storing a currently-executed program and data related to the currently-executed program, and for various other purposes. Predetermined address regions of the RAM 3 are allocated to various functions and used as various registers, flags, tables, temporary memories, etc.

The input operation section 4 may be in the form of an input device, such as a microphone, for inputting, for example, a tone signal of a human voice uttered by a user or a performance tone of a musical instrument performed by the user, various operators or controls, such as a performance start/stop button for instructing a start/stop of a performance (input of tone signals) and switches for setting various parameters, a numerical keypad for inputting numerical value data, a keyboard for inputting letter/character data, a mouse, and/or the like. The microphone may be any other desired device than the microphone, such as a performance control like a keyboard for generating, in response to user's operation, chord information necessary for generating a harmony tone signal, etc., or a data input device, such as a sequencer, for supplying chord information, prestored in the ROM 2 or the like, in performance progression order.

The display section 5, which is in the form of a liquid crystal display (LCD) panel, CRT or the like, displays various kinds of information, such as a musical score pertaining to a lead tone to be generated on the basis of a tone signal input via the microphone or the like and/or a musical score pertaining to one or a plurality of harmony tones to be generated on the basis of generated harmony tone signals, parameter settings set via various controls, a list of various prestored data, controlling states of the CPU 1, and the like.

The tone generator 6, which is capable of simultaneously generating tone signals in a plurality of tone generation channels, generates a tone signal of a lead tone in a given tone generation channel on the basis of a waveform signal obtained by temporarily buffering a tone signal input, for example, via the microphone, and also generates harmony tone signals in other tone generation channels on the basis of the temporarily buffered waveform of the input tone signal. As a tone source waveform of the lead tone, the waveform of the input tone signal may be used directly or as-is, or a waveform controlled in tone pitch, tone color and/or the like as necessary on the basis of the temporarily buffered waveform of the input tone signal may be used. Further, as a tone source waveform of each of the harmony tones, a waveform based on the temporarily buffered waveform of the input tone signal, or other suitable tone source waveform, may be used.

The tone signals generated by the tone generator 6 are audibly generated or sounded via a tone system 6A including an amplifier and speaker. In audibly generating the input tone signal, harmony tone signals, the tone generator 6 can impart various effects, such as a gender (type and depth of voice quality like that of a male voice or female voice), tremolo, tone volume, panning (tone image localization), detune and reverberation. The tone generator 6 and tone system 6A may be constructed in any desired conventionally-known manner. For example, the tone generator 6 may employ, as a tone source waveform generation or reproduction method, any tone synthesis method, such as the FM, PCM, physical model, formant synthesis or MP3. Further, the whole or part of the tone generator 6 may be implemented by either dedicated hardware or software processing performed by the CPU 1 or DSP (Digital Signal Processor).

The communication interface (I/F) 7 is an interface for communicating various information, such as control programs and various data, between the electronic music apparatus of the invention and not-shown external equipment. The communication interface 7 may be a MIDI interface, LAN, the Internet, telephone line network or the like. It should also be appreciated that the communication interface 7 may be of either or both of wired and wireless types.

The storage device 8 stores therein various information, such as harmony tables prepared in advance and various control programs for execution by the CPU 1. The storage device 8 may also store therein an input tone signal and generated harmony tone signals. In a case where a particular control program is not prestored in the ROM 2, the control program may be prestored in the storage device (e.g., hard disk device) 8, so that, by reading the control program from the storage device 8 into the RAM 3, the CPU 1 is allowed to operate in exactly the same way as in the case where the particular control program is stored in the ROM 2. This arrangement greatly facilitates version upgrade of the control program, addition of a new control program, etc. The storage device 8 may use any of various recording media other than the hard disk (HD), such as a flexible disk (FD), compact disk (CD), magneto-optical disk (MO) and digital versatile disk (DVD). Alternatively, the storage device 8 may be a semiconductor memory.

The tone signal generation apparatus (electronic music apparatus) of the present invention is not limited to the type where the input operation section 4, display section 5, tone generator 6, etc. are incorporated together within the apparatus. For example, the tone signal generation apparatus (electronic music apparatus) of the present invention may be constructed in such a manner that the above-mentioned components 4, 5 and 6 are provided separately and interconnected via communication interfaces, such as MIDI interfaces, various networks and/or the like.

It should be appreciated that the tone signal generation apparatus (electronic music apparatus) and program of the present invention may be applied to any forms of apparatus and equipment, such as karaoke apparatus, electronic musical instruments, personal computers, portable communication terminals like portable phones and game apparatus. In the case where the tone signal generation apparatus and program of the present invention are applied to a portable communication terminal, all of the above-described functions need not be performed by the portable communication terminal alone, in which case a server may have part of the above-described functions so that the above-described functions can be realized by an entire system comprising the terminal and the server.

The tone signal generation apparatus (electronic music apparatus) shown in FIG. 1 has a harmony tone generation (adding) function for performing frequency analysis of a tone signal input via the microphone or the like to detect a tone pitch of the input tone signal (and ultimately identify a particular tone pitch corresponding to any one of the musical pitch names), then newly determining one or a plurality of target pitches (or tone pitches) (that are particular tone pitches corresponding to some of the musical pitch names) on the basis of the thus-identified tone pitch and chord information input via the keyboard or the like and then automatically generating one or a plurality of harmony tone signals having the thus-determined target pitches.

Here, the target pitches are set at some of syllable names of a twelve-note scale (or pitch names) in accordance with any one of the harmony tables (tone pitch determination tables) shown in FIG. 2 and on the basis of the particular tone pitch, corresponding to any one of the musical pitch names, obtained through the frequency analysis of the input tone signal, and the chord information input via the keyboard or the like (so-called chord input scheme). FIG. 2 is a conceptual diagram showing an example data format of the harmony tables. More specifically, FIG. 2 shows one of the harmony tables which is to be referenced when a "C major" has been designated as the chord information, and which is of a data format or organization for generating a group of harmony tone signals.

The harmony tables are stored in the ROM 2 or storage device 8 in association with a plurality of chords, one harmony table per chord, and a corresponding one of the tables is designated in accordance with the input chord information. As seen from FIG. 2, each of the harmony tables defines target pitches of one harmony group for each particular tone pitch (input tone pitch), corresponding to any one of the musical pitch names, obtained through the frequency analysis of an input tone signal. Note that, in the illustrated example of FIG. 2, input tone pitches are indicated by pitch names "C, C#, D, D#, E, F, F#, G, G#, A, A#, B", and target pitches are also indicated by pitch names.

Regarding the pitch name representation of the target pitches in FIG. 2, target pitch "G" indicates a "G" note in the same octave region as an input tone pitch, target pitch "C+" indicates a "C" note one octave higher than an input tone pitch, and so on. Although not particularly shown in FIG. 2, target pitch "E−" indicates an "E" note one octave lower than an input tone pitch. Thus, according to the illustrated example of FIG. 2, when the input tone pitch is "E3", "G3" is determined as a target pitch of a harmony tone signal, when the input tone pitch is "G2#", "C3" is determined as a target pitch of a harmony tone signal, and so on. Note that, in the illustrated example of FIG. 2, octave regions are demarcated between note "C" and note "B".

Whereas the foregoing have described the first embodiment as employing, as the scheme for determining a tone pitch of a harmony tone signal, the chord input scheme that determines a tone pitch on the basis of chord information (more specifically, harmony table), the present invention may employ any other conventionally-known scheme that determines a tone pitch of a harmony tone signal without based on chord information. For example, a so-called "interval-fixed scheme" may be employed where each harmony tone signal is determined or set uniformly at a tone pitch that is at a predetermined pitch interval from a tone pitch of an input tone signal (e.g., four semitones above the tone pitch of the input tone signal).

Figure 3:
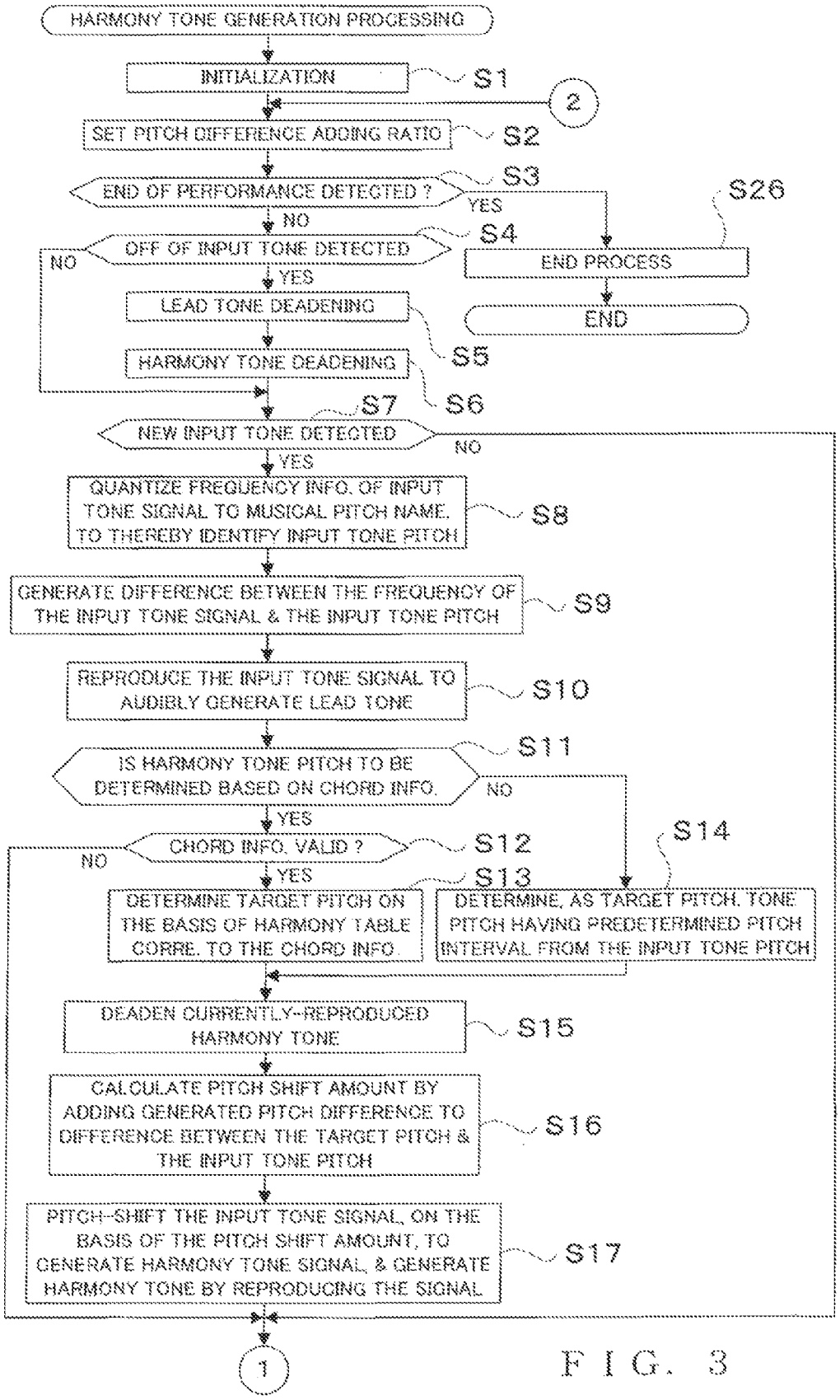
FIG. 3 is a flow chart showing a former half of an example of harmony tone generation processing performed in the first embodiment.
Figure 4:
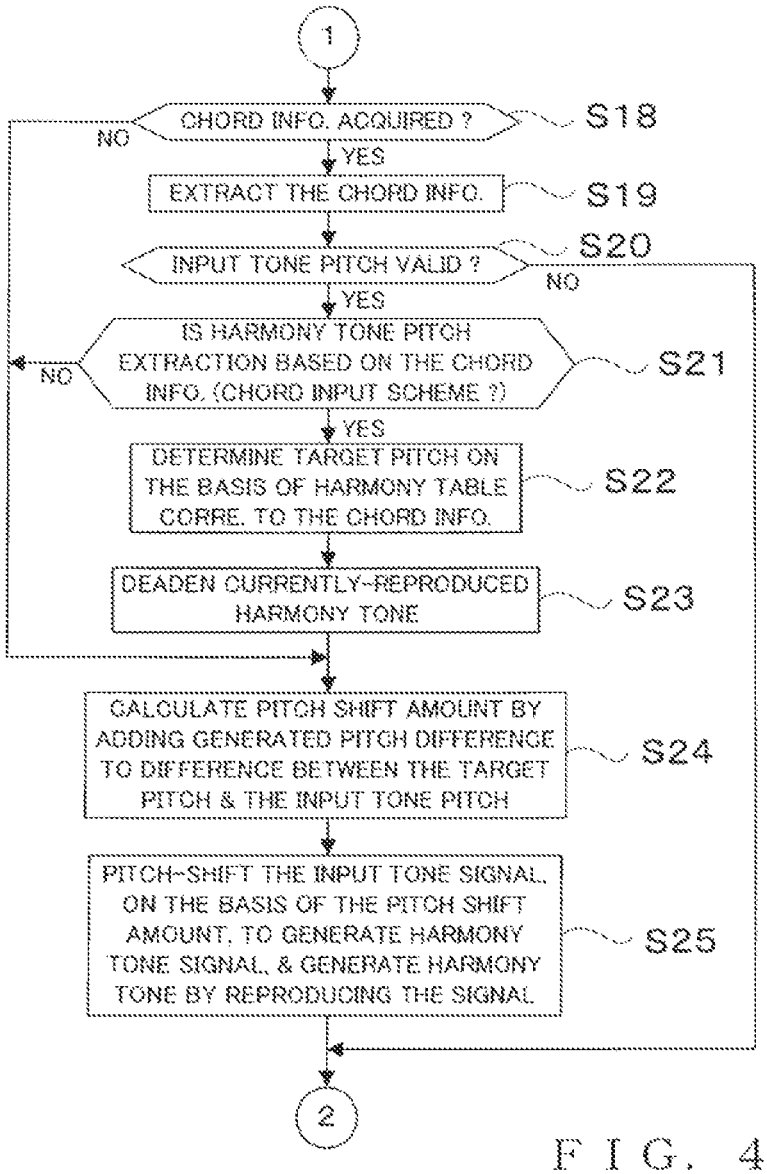
FIG. 4 is a flow chart showing a latter half of an example of harmony tone generation processing performed in the first embodiment.

The tone signal generation apparatus (electronic music apparatus) shown in FIG. 1 can of course generate a harmony tone signal of a constant tone pitch (target pitch) with no tone pitch variation. In addition, if an input tone signal has tone pitch variation (less than 100 cents), the tone signal generation apparatus can generate a harmony tone signal having the tone pitch variation reflected therein as desired. With reference to FIGS. 3 to 5, the following describe such a harmony tone generation function for generating a harmony tone signal having pitch variation of an input tone signal reflected therein as needed. FIGS. 3 and 4 are a flow chart showing an example of "harmony tone generation processing" where the aforementioned harmony tone generation function is implemented by the above-mentioned CPU 1. More specifically, for convenience of illustration, a former half of the harmony tone generation processing is shown in FIG. 3, while a latter half of the harmony tone generation processing following the former half is shown in FIG. 4. The harmony tone generation processing is started up, for example, in response to a performance start instruction given by the user operating the performance start/stop button and then repetitively performed until a performance stop is instructed. FIGS. 5A to 5E are conceptual diagrams showing example details explanatory of the harmony tone generation processing.

As shown in FIG. 3, an initial setting process is performed, which, for example, clears various buffers, such as a chord buffer for storing chord information, a lead tone buffer for storing an input tone pitch, a note buffer for storing a harmony tone pitch (target pitch) and a difference buffer for storing a pitch difference between an input tone pitch and a target pitch, and selects a harmony tone pitch determination scheme (e.g., the aforementioned chord input scheme or interval-fixed scheme) responsive to user operation. Then, a pitch difference adding ratio is set at step S2. The pitch difference adding ratio (i.e., tone pitch adjustment information) is a parameter that, on the basis of a pitch difference, determines a degree (ratio value in a range of, for example, 0-100%) of tone pitch variation to be imparted to a harmony tone pitch. Such a pitch difference adding ratio is referenced when a harmony tone signal is to be generated, so that a harmony tone can be adjusted in tone pitch (i.e., tone pitch adjustment less than 100 cents), as will be later described.

At step S3, a determination is made as to whether a stop of a performance has been detected. If it has been determined by the CPU 1 that a stop of a performance has been detected (YES determination at step S3), the CPU 1 ends the instant processing after performing an end process for deadening or silencing a currently audibly generated lead tone and/or harmony tone, at step S26. If, on the other hand, it has been determined that a stop of a performance has not been detected (NO determination at step S3), the CPU 1 further determines, at step S4, whether an end (i.e., turning-off) of an input tone has been detected.

A conventionally-known tone pitch detection process as shown in FIG. 6 is performed sequentially or successively (e.g., at a predetermined interrupt frequency), in parallel with the harmony tone generation processing. More specifically, an A/D converter circuit digitizes an input tone signal input via the microphone or the like, and the tone pitch detection process detects a specific tone pitch of the digitized input tone signal through a "frequency detection process" (step S30 of FIG. 6), to thereby obtain a specific frequency signal (specific tone pitch information). Note that the specific tone pitch is a tone pitch before being rounded to a pitch name frequency (i.e., normalized pitch). In a "vowel segment detection" process performed at step S31, vowel segments of the input tone signal are detected, and the input tone signal is segmented at each of the detected vowel segments. Because the "frequency detection process" may employ any suitable frequency detection technique, such as the zero-cross method, known in the tone analysis field, a detailed description about the frequency detection process is omitted here. While a given (same) vowel segment lasts, it is regarded that an ON state of an input tone is currently continuing. At step S4 of FIG. 3, the CPU 1 determines whether an end (i.e., turning-off) of the input tone has been detected or not, by determining whether a same vowel segment is currently continuing.

Referring back to FIG. 3, if it has been determined that turning-off of an input tone has not been detected, i.e. that a given vowel segment is currently continuing, a NO determination is made at step S4, so that the CPU 1 jumps to step S7. If, on the other hand, it has been determined that turning-off of an input tone has been detected, i.e. that a given vowel segment has ended, a YES determination is made at step S4, so that the CPU 1 performs a process for deadening a lead tone audibly generated on the basis of reproduction of an input tone signal (step S5) and also a process for deadening a harmony tone audibly generated on the basis of reproduction of a harmony tone signal (step S6).

Then, at step S7, a determination is made as to whether a new input tone (i.e., input tone signal of a new vowel segment) has been detected. If no new input tone has been detected, i.e. the given vowel segment has not ended yet (NO determination at step S7), the CPU 1 jumps to step S18 of FIG. 4. If it has been determined that a new input tone has been detected, i.e. that the given vowel segment has ended and has been replaced with a new or different vowel segment (YES determination at step S7), the frequency information of the input tone signal is quantized to a musical pitch name, so as to identify an input tone pitch (step S8). Namely, the frequency signal converted through the aforementioned "frequency detection" process is subjected to a "flattening process" to flatten (or smooth) variation in the frequency signal. The thus-flattened frequency signal is subjected to a "syllable name detection" process, where it is discretized, per predetermined time period, to any one of syllable names of a twelve-note scale (musical pitch names). Namely, the flattened frequency signal is rounded to a predetermined tone pitch corresponding to any one of the musical pitch names defined in semitones (100 cents), so that the input tone signal is identified as being of any one of tone pitches corresponding to the musical pitch names (such tone pitches will hereinafter be referred to as "normalized pitches". The thus-identified input tone pitch (i.e., normalized pitch) is stored into the lead tone buffer. At that time, an operation is performed for storing waveform factor data of one cyclic period cut out using a window function corresponding to the above-mentioned detected normalized pitch. Updating of thus-stored waveform factor data of one cyclic period may be effected sequentially.

Figure 5A:
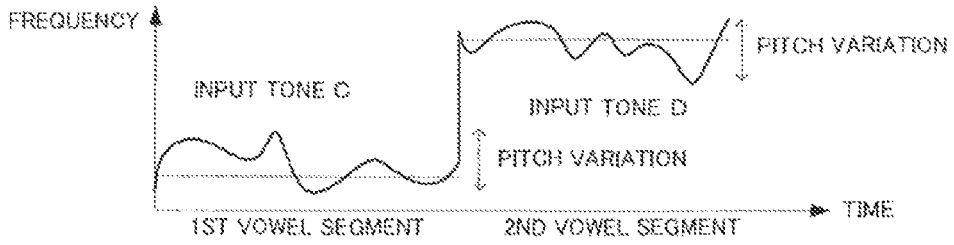
FIGS. 5A to 5E are conceptual diagrams showing example details explanatory of the harmony tone generation processing performed in the first embodiment.
Figure 5B:
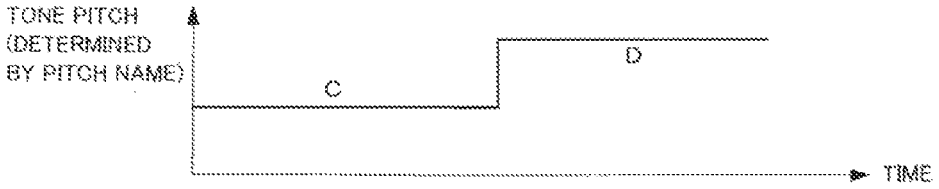

FIG. 5A shows an example of specific pitch variation of a continuous input tone signal. In this example, the specific tone pitch of the input tone signal transits from a first vowel segment, which presents slight tone pitch variation (of less than a semitone, e.g. in a range of about several cents to tens of cents) above and below the tone pitch of pitch name "C", to a second vowel segment which presents slight tone pitch variation (of less than a semitone, e.g. in a range of about several cents to tens of cents) above and below the tone pitch of pitch name "D". If, for example, phonemes of lyrics sung by a human voice are "a i" in the Japanese language, the first vowel segment represents a vowel phoneme "a" of the syllable "a" in the Japanese language, and the second vowel segment represents a vowel phoneme "i" of the syllable "i" in the Japanese language. By quantizing the frequency information of the input signal having such (tone) pitch variation on the pitch-name-by-pitch-name basis (i.e., by detecting normalized pitches), the input tone pitch (normalized pitch) can be identified to be the tone pitch of pitch name "C" for the first vowel segment and to be the tone pitch of pitch name "D" for the second vowel segment.

At step S9, a pitch difference (information pertaining to a pitch difference) is generated, for each of the vowel segments, between the frequency information (specific tone pitch) of the input tone signal and the identified input tone pitch (normalized pitch).

Figure 5C:
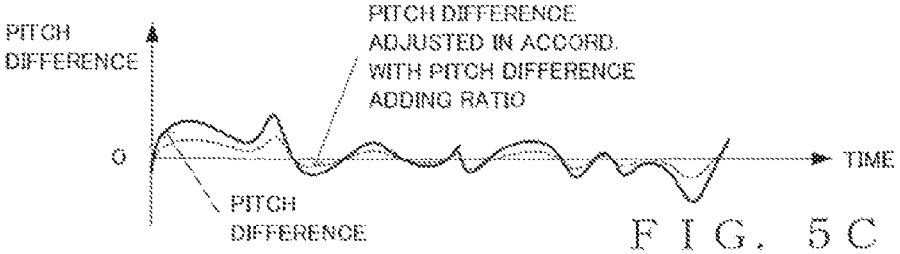

FIG. 5C shows, by solid line, example pitch differences generated for the individual vowel segments. As seen from the figure, the aforementioned operations generate pitch differences, reproducing as-is the pitch variation contained in the input tone signal, using a pitch difference "0" as a reference. Note that, because each pitch difference equal to or greater than 1.00 cents should fundamentally be detected as a separate normalized pitch, the maximum value of pitch differences to be generated in the pitch difference generation here may be limited to less than 100 cents. In other words, each temporary pitch difference equal to or greater than 100 cents that could not be detected as a "normalized pitch" may be ignored in the pitch difference generation here; for example, each temporary pitch difference equal to or greater than 100 cents each temporary pitch difference equal to or greater than 100 cents may be rounded to 99 cents or may be replaced by an immediately-preceding pitch difference less than 100 cents. Alternatively, each temporary pitch difference equal to or greater than 100 cents that could not be detected as a "normalized pitch" may be reflected in the pitch difference generation at the step S9. For convenience, FIG. 5C also shows, by broken line, pitch differences having been adjusted using the pitch difference adding ratio set at step S2 above.

At step S10, the input tone signal is reproduced to audibly generate a lead tone. Note that the lead tone may be generated in such a manner that the pitch variation contained in the original input tone signal can be reproduced just as it is in its entirety by the temporarily-buffered input tone signal being sequentially reproduced. Alternatively, the lead tone may be generated in such a manner that the pitch variation contained in the original input tone signal can be reproduced using the waveform factor data of one cyclic period stored and sequentially updated as above and on the basis of combinations of the normalized pitches and the pitch differences. As another alternative, the lead tone may be generated in such a manner that the pitch variation contained in the original input tone signal can be reproduced using a desired tone source waveform and on the basis of combinations of the normalized pitches and the pitch differences.

At step S11, a determination is made as to whether a harmony tone pitch should be determined on the basis of chord information, i.e. whether the above-mentioned chord input scheme is currently selected as the scheme for determining a tone pitch of a harmony tone signal. If it has been determined that the chord input scheme is not currently selected (NO determination at step S11), a tone pitch having a predetermined pitch interval from the input tone pitch (e.g., four semitones higher than the input tone pitch) is determined as a target pitch in accordance with the interval-fixed scheme, at step S14. The thus-determined target pitch is stored into the note buffer. If, on the other hand, it has been determined that the chord input scheme is currently selected (YES determination at step S11), a further determination is made, at step S12, as to whether chord information stored in the chord buffer is valid or not.

If it has been determined that chord information stored in the chord buffer is not valid, i.e. no chord information has been input and stored in the chord buffer (NO determination at step S12), the CPU 1 jumps to the operation of step S18 shown in FIG. 4. If, on the other hand, it has been determined that chord information stored in the chord buffer is valid, i.e. some chord information has been input and stored in the chord buffer (YES determination at step S12), the CPU 1 goes to step S13, where it determines a tone pitch of a harmony tone signal (i.e., target pitch) by referencing a corresponding one of the harmony tables, stored in the ROM 2 or storage device 8, on the basis of the chord information stored in the chord buffer and the input tone pitch stored in the lead tone buffer. For example, if the input chord information is "C major", "E" is determined as the target pitch in the first vowel segment shown in FIG. 5A and "G" is determined as the target pitch in the second vowel segment shown in FIG. 5A, according to the corresponding harmony table of FIG. 2. The thus-determined target pitches are stored into the note buffer.

At step S15, a harmony tone currently audibly generated is deadened, if any. At next step S16, the CPU 1 compares, for each of the vowel segments, the target pitch stored in the note buffer and the input tone pitch stored in the lead tone buffer, to thereby determine a difference therebetween (this difference corresponds to a pitch shift amount used in the conventionally-known apparatus for generating a harmony tone signal. Then, the CPU 1 calculates a pitch shift amount by adding the pitch difference, generated at step S9, to the thus-determined difference. Note, however, that the pitch difference to be added at this time is an adjusted pitch difference obtained by adjusting pitch variation of the pitch difference, stored in the difference buffer, in accordance with the pitch difference adding ratio (pitch adjustment information). At step S17, the CPU 1 pitch-shifts the input tone signal (more specifically, the stored waveform factor data of one cyclic period) on the basis of the calculated pitch shift amount, to thereby generate, on the basis of the target pitch, a harmony tone signal pitch-modulated reflecting herein the pitch variation contained in the input tone signal.

Figure 5D:
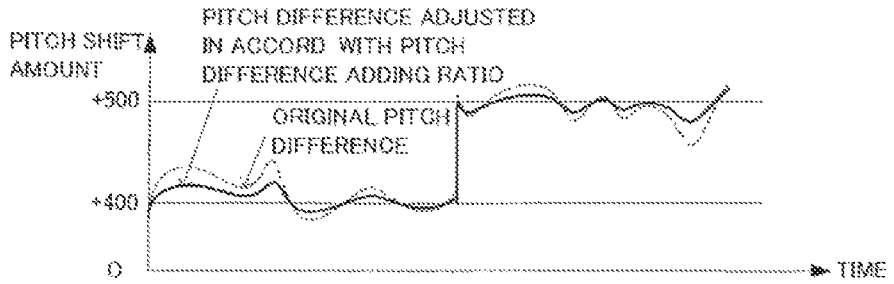

FIG. 5D shows, by solid line, pitch shift amounts calculated at step S16 as above in accordance with the adjusted pitch differences adjusted in pitch variation in accordance with the pitch difference adding ratio, and also shows for reference, by broken line, virtual pitch shift amounts determined in accordance with original (namely, "before-adjusted") pitch differences generated at step S9. As shown in FIG. 5D, a pitch shift amount with a pitch varying up and down from a basic pitch shift amount "+400" is obtained for the first vowel segment, and a pitch shift amount with a pitch varying up and down from a basic pitch shift amount "+500" is obtained for the second vowel segment. Harmony tone signals shown in FIG. 5E can be generated by the CPU 1 pitch-shifting the input tone signal (the above-mentioned stored waveform factor data) in each of the vowel segments in accordance with the pitch shift amount determined for that vowel segment.

Figure 5E:
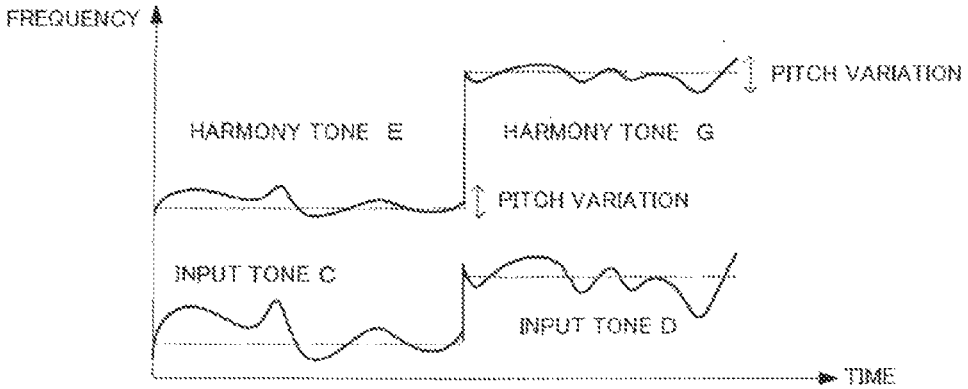

In the conventionally-known apparatus, a harmony tone signal having a constant pitch, such as "E" or "G", is generated as seen from broken like in FIG. 5E. By contrast, in the instant embodiment, a harmony tone signal is generated which more or less reflects therein pitch variation contained in an input tone signal. Namely, the instant embodiment can adjust as desired pitch variation of a harmony tone signal, in accordance with a value of a currently-set pitch difference adding ratio, so as to become greater or smaller than the pitch variation of the input tone signal. For example, settings may be made in advance such that, if the pitch difference adding ratio is 50%, a harmony tone signal generated presents same pitch variation as an input tone signal, that, as the difference adding ratio is decreased from 50% toward 0%, a harmony tone signal generated presents pitch variation smaller than that of an input tone signal, and that, if the difference adding ratio is 0%, a harmony tone signal generated presents a constant tone pitch with no pitch variation as in the conventionally-known apparatus. Conversely, settings may be made in advance such that, as the difference adding ratio is increased from 50% toward 100%, a harmony tone signal generated presents pitch variation greater than that of an input tone signal.

At step S18, a determination is made as to whether chord information input, for example, by the user operating the keyboard or the like (or automatically given or supplied in response to a karaoke accompaniment or the like) has been acquired. If it has been determined by the CPU 1 that such chord information has not been acquired (NO determination at step S18), the CPU 1 jumps to step S24. If, on the other hand, it has been determined that such chord information has been acquired (YES determination at step S18), the CPU 1 extracts the chord information and stores the extracted chord information into the chord buffer, at step S19. Further, at step S20, a determination is made as to whether the input tone pitch stored in the lead tone buffer is valid or not. If it has been determined that the input tone pitch is not valid (NO determination at step S20), the CPU 1 reverts to step S2 of FIG. 3. If, on the other hand, it has been determined that the input tone pitch is valid (YES determination at step S20), a further determination is made, at step S21, as to whether the chord input scheme is currently selected as the scheme for determining a tone pitch of a harmony tone signal. If it has been determined that the chord input scheme is not currently selected (NO determination at step S21), the CPU 1 jumps to step S24.

If it has been determined that the chord input scheme is currently selected (YES determination at step S21), the CPU 1 references a corresponding one of the harmony tables, stored in the ROM 2 or storage device 8, on the basis of the chord information stored in the chord buffer and the input pitch stored in the lead tone buffer, at step S22. At step S23, a harmony tone currently audibly generated is deadened, if any. At next step S24, the CPU 1 compares the target pitch stored in the note buffer and the input tone pitch stored in the lead tone buffer, to thereby determine a difference therebetween (that corresponds to a pitch shift amount used in the conventionally-known apparatus). Then, the CPU 1 calculates a pitch shift amount by adding the generated pitch difference to the thus-determined difference. Note, however, that the pitch difference to be added at this time is an adjusted pitch difference obtained by adjusting pitch variation of the pitch difference, stored in the difference buffer, in accordance with the pitch difference adding ratio. At step S25, the CPU 1 pitch-shifts the input tone signal (more specifically, the stored waveform factor data of one cyclic period) on the basis of the calculated pitch shift amount, to thereby generate a harmony tone signal, reflecting therein the pitch variation contained in the input tone signal, on the basis of the target pitch and audibly generate a harmony tone by reproducing the harmony tone signal.

As described above, the tone signal generation apparatus of the present invention determines, for each of the predetermined segments, a pitch difference between a tone pitch of an input tone signal detected through analysis of the tone signal and a tone pitch, corresponding to any one the pitch names, identified for the predetermined segment of the input tone signal on the basis of the pitch detection of the input tone signal. Then, pitch shift amounts (that correspond to the pitch shift amounts in the conventionally-known apparatus) necessary for pitch-shifting the input tone signal to tone pitches of one or a plurality of harmony tones determined in accordance with the detected tone pitch are modified by adding pitch variation components, based on the pitch difference, to the pitch shift amounts. Because the pitch difference indicates pitch variation (pitch variation component) relative to the original tone pitch contained in the input tone signal, each of the modified pitch shift amounts having the pitch fluctuation component added thereto has the pitch variation of the input tone signal imparted thereto. Therefore, by pitch-shifting the input tone signal on the basis of the modified pitch shift amounts, it is possible to generate one or a plurality of harmony signals having pitch variation based on the determined one or a plurality of tone pitches. Thus, the tone signal generation apparatus of the present invention can generate one or a plurality of harmony signals that have pitch variation similar to pitch variation of an input tone signal and thus do not give an uncomfortable feeling to the user, by reflecting the pitch variation of the input tone signal in the harmony signals.

Whereas the first embodiment of the present invention has been described with reference to the accompanying drawings, it should be appreciated that the present invention is not limited to the described embodiment and may be modified variously. For example, the present invention may be modified to generate a harmony tone of a constant tone pitch (target pitch) with no pitch variation as in the conventionally-known apparatus by pitch-shifting an input tone signal on the basis of a pitch difference obtained by comparison between the target pitch and an input tone pitch (this difference corresponds to the pitch shift amount used in the conventionally-known apparatus), and then reflect pitch variation of the input tone signal in the harmony tone signal by performing pitch modulation control for merely adding, to the generated harmony tone signal, a pitch difference adjusted in accordance with a pitch difference adding ratio.

Note that the term "pitch variation" or pitch modulation used in this specification may be interpreted as embracing not only periodic pitch change like a vibrato but also non-periodic pitch change 15, like a bend-up or bend-down, as well as minute pitch change that cannot be recognized by the user as a rendition style expression.

Also note that chord information input for generating a harmony tone signal may be one detected from information input in response to user's operation via a performance control, such as a keyboard provided in or connected to the tone signal generation apparatus of the present invention, one obtained by chord names being sequentially input to the apparatus, or one automatically supplied in response to a karaoke accompaniment.

Needless to say, in the case where a chord is input in response to user's performance operation, the chord is detected on the basis of a key depression state. In such a case, any desired chord designation/detection scheme may be employed, such as a so-called fingered scheme where the user designates a chord by depressing all of keys corresponding to actual chord component tones, so-called single-fingered scheme where the user designates a chord by depressing one to about three keys on the basis of a predetermined rule, or a scheme where the user designates a root and type of each chord by operating predetermined switches provided on an operation panel.

Further, whereas the above-described first embodiment is constructed to generate a group of harmony tone signals in response to an input tone signal, it may be modified to simultaneously generate a plurality of groups of harmony tone signals. In this case, the target pitch may be differentiated between the plurality of groups; for example, a harmony tone signal of one group may have a pitch interval three degrees higher than a lead tone, while a harmony tone signal of another group may have a pitch interval five degrees higher than a lead tone. Further, in such a case, the modulation degrees (adjustment amounts) corresponding to pitch differences relative to respective target pitches of the harmony tone signals of the individual groups may be made the same or common or may be made adjustable independently among the harmony tone signals.

Further, whereas the above-described first embodiment is constructed to determine a tone pitch of a harmony tone signal using as-is a pitch detection result of an input tone signal, it may be modified to determine a tone pitch of a harmony tone signal using the pitch detection result of the input tone signal after performing pitch conversion of the pitch detection result for, for example, raising or lowering the detected pitch by one octave or three semitones.

Furthermore, whereas the first embodiment has been described above in relation to the case where an input tone signal on the basis of which to generate a harmony tone signal is a user's voice, the present invention is not so limited. For example, the input tone signal on the basis of which to generate a harmony tone signal may be a performance tone of a musical instrument or the like input via the microphone or a tone signal stored in memory or delivered from outside the apparatus.

Next, a description will be given about a second embodiment of the tone signal generation apparatus where harmony tone signals are generated with a plurality of types of generation schemes, with reference to FIGS. 7 to 15E. Note that the hardware construction shown in FIG. 1 and the pitch detection process shown in FIG. 6 are applied to the second embodiment too. Note that, of FIGS. 15A to 15E showing example behavior of the second embodiment, FIGS. 15A to 15D are similar to FIGS. 5A to 5D, and FIG. 15E shows characteristic features of the second embodiment.

In the second embodiment, harmony tables shown in FIGS. 7A and 7B are used in place of the harmony tables shown in FIG. 2. FIG. 7A shows a harmony table to be referenced when a chord name "C major chord" has been designated as chord information, and FIG. 7B shows a harmony table to be referenced when a chord name "C minor chord" has been designated as chord information. Each of these harmony tables is shown as being of a data format such that a plurality of harmony tone signals of corresponding chord component notes are generated in response to a particular tone pitch detected from an input tone signal. The harmony tables are stored in the ROM 2 or storage device 8 in association with a plurality of chords (chord names), one harmony table per chord (chord name), and a corresponding one of the tables is designated in accordance with the input chord information.

FIGS. 8A and 8B show examples of pitch difference adding ratio tables defining a plurality of pitch difference adding ratios (a plurality of pieces of pitch adjustment information). More specifically, the pitch difference adding ratio table (or harmony-tone-specific pitch difference adding ratio table) shown in FIG. 8A define pitch difference adding ratios (pitch adjustment information) to be applied to harmony tones, such as a first harmony tone, second harmony tone, third harmony tone, . . . (corresponding to Nos. 1, 2, 3, . . . in the figure) in predetermined decreasing or increasing (or any other desired) order of input tone pitches. Each of the pitch difference adding ratios is pitch adjustment information for adjusting a difference between a specific pitch and a normalized pitch (as will be later described); note that such a difference represents a level of pitch variation. According to the illustrated example, if harmony target pitches have been identified as "E3", "G3" and "C4", and if a level of pitch variation of an input tone signal is assumed to be 100%, the pitch adjustment information adjusts the differences between the specific pitch and the normalized pitches in such a manner that pitch variation of individual harmony tones of these pitches "E3", "G3" and "C4" become "20%", "25%" and "15%", respectively, of the pitch variation of the input tone signal.

FIG. 8B shows the pitch difference adding ratio table is defining level-specific pitch difference adding ratios (pitch adjustment information) to be applied to different levels (in this case, "great", "medium", "small" and "zero" levels) of pitch variation to be imparted to harmony tones.

Which one of the above-mentioned two types of pitch difference adding ratio tables should be used is determined in accordance with a harmony tone generation rule applied or selected, as will be described later. Further, in the case where the level-specific pitch difference adding ratios are used, which level-specific pitch difference adding ratios should be applied to which harmony tones are predetermined in accordance with a harmony tone generation rule selected, as will be described in detail later in relation to individual rule processes. Note that the pitch difference adding ratios are not limited to the aforementioned and may be in the form of specific numerical values.

By operating predetermined setting controls etc. provided on the input operation section 4, the user can edit or set the "pitch difference adding ratios" (pitch adjustment information), defined in the pitch difference adding ratio tables, to desired values.

Figure 9:
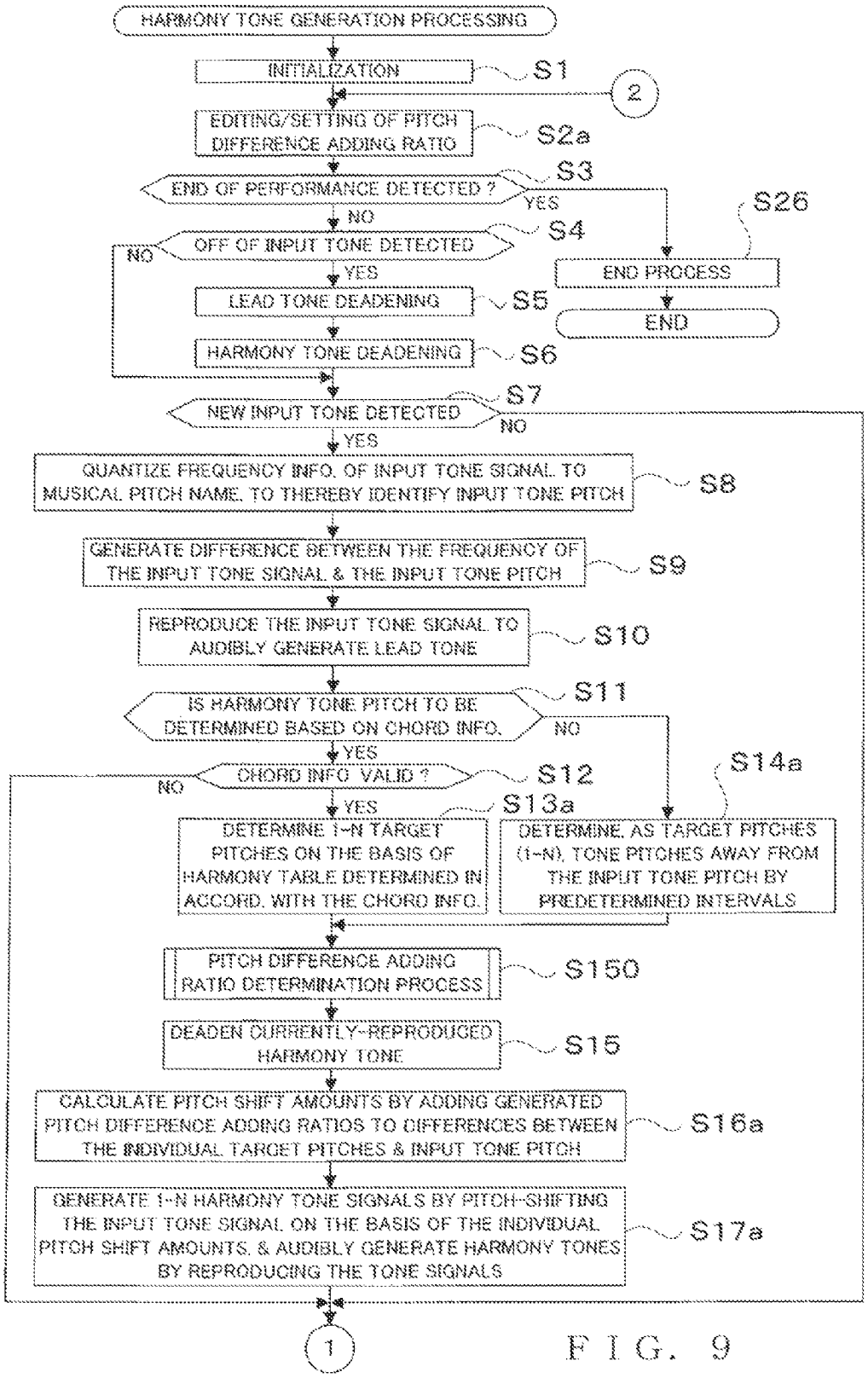
FIG. 9 is a flow chart showing a former half of harmony tone generation processing performed in the second embodiment.
Figure 10:
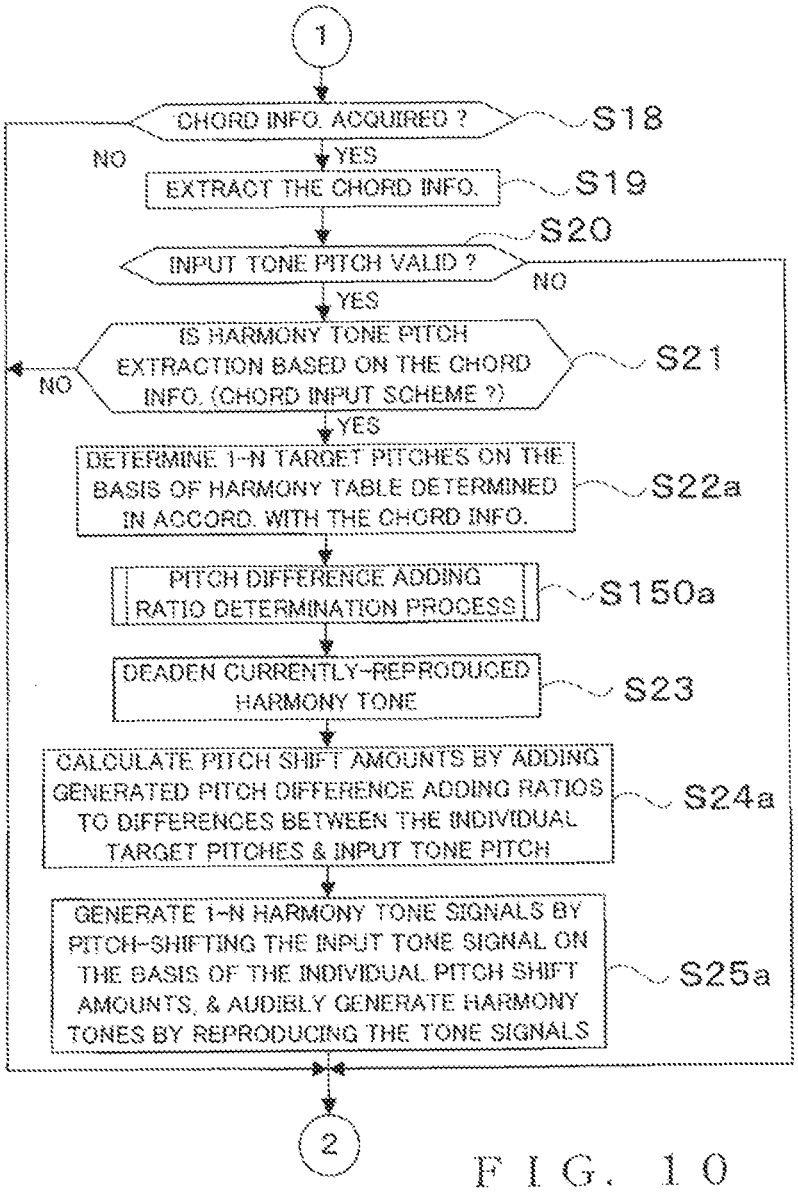
FIG. 10 is a flow chart showing a latter half of the harmony tone generation processing performed in the second embodiment.

FIGS. 9 and 10 are a flow chart of an example of "harmony tone generation processing" performed in the second embodiment by the CPU 1, which is a modification of the harmony tone generation processing shown in FIGS. 3 and 4. In FIGS. 9 and 10, steps of the same step numbers as in FIGS. 3 and 4 function in the same manner as in FIGS. 3 and 4 and thus will not be described here to avoid unnecessary duplication. The following describe only differences from the harmony tone generation processing shown in FIGS. 3 and 4.

In FIG. 9, step S2*a* is a modification of step S2 shown in FIG. 3. At step S2*a*, the user edits the pitch difference adding ratio tables of FIGS. 8A and 8B to thereby perform desired editing/setting of the pitch difference adding ratios.

If it has been determined that the aforementioned chord input scheme is not currently selected (NO determination at step S11), the CPU 1 branches to step S14*a* that is a modification of step S14 of FIG. 3. At step S14*a*, a plurality of pitches that are away from an input tone pitch by predetermined pitch intervals (e.g., higher than the input tone pitch by four semitones (i.e., major thirds), seven semitones higher (i.e., perfect fifth), etc.) are determined as target pitches in accordance with the aforementioned interval-fixed scheme. The thus-determined target pitches are stored into the note buffer.

Figure 15A:
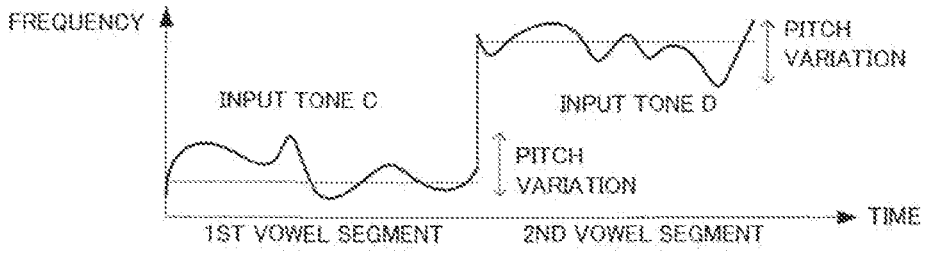
FIGS. 15A to 15E are conceptual diagrams showing example details explanatory of the harmony tone generation processing performed in the second embodiment.
Figure 15B:
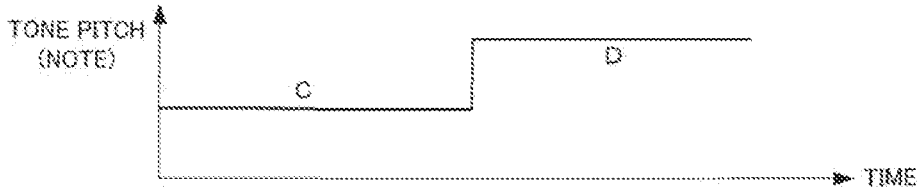
Figure 15C:
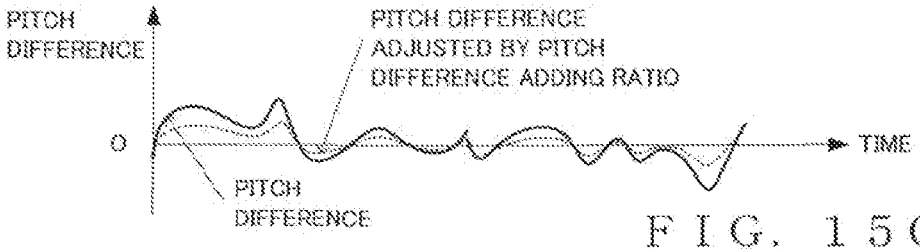
Figure 15D:
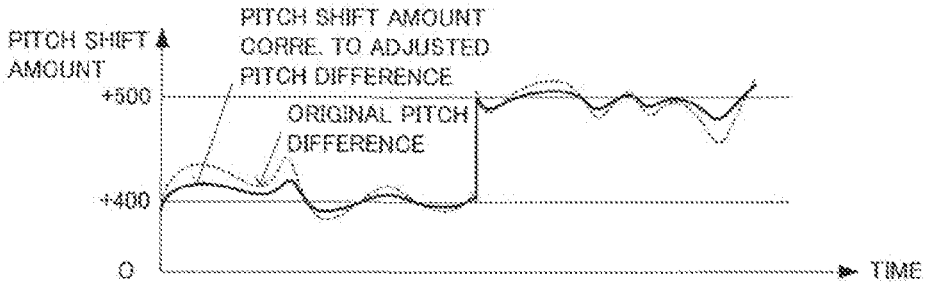

If it has been determined that the chord input scheme is currently selected and the chord information stored in the chord buffer is valid (YES determination at step S12), the CPU 1 proceeds to step S13*a* that is a modification of step S13 of FIG. 3. At step S13*a*, the CPU 1 references a harmony table to determine a plurality of tone pitches as target pitches of harmony tone signals. For example, when the input chord information is a "C major chord", and if an input tone pitch of a first vowel segment is "C" as shown in FIG. 15A, target pitches "E", "G" and "C+1" ("C+1" means one octave higher than the input tone pitch) are determined as the target pitches according to the harmony table of FIG. 7A. Also, in this case, if an input tone pitch of a second vowel segment is "D", target pitches "G", "C+1" and "E+1" are determined as the target pitches according to the harmony table of FIG. 7A. The thus-determined one or more target pitches are stored into the note buffer.

At step S150 inserted immediately before step S15, the CPU 1 performs a pitch difference adding ratio determination process.

Figure 11:
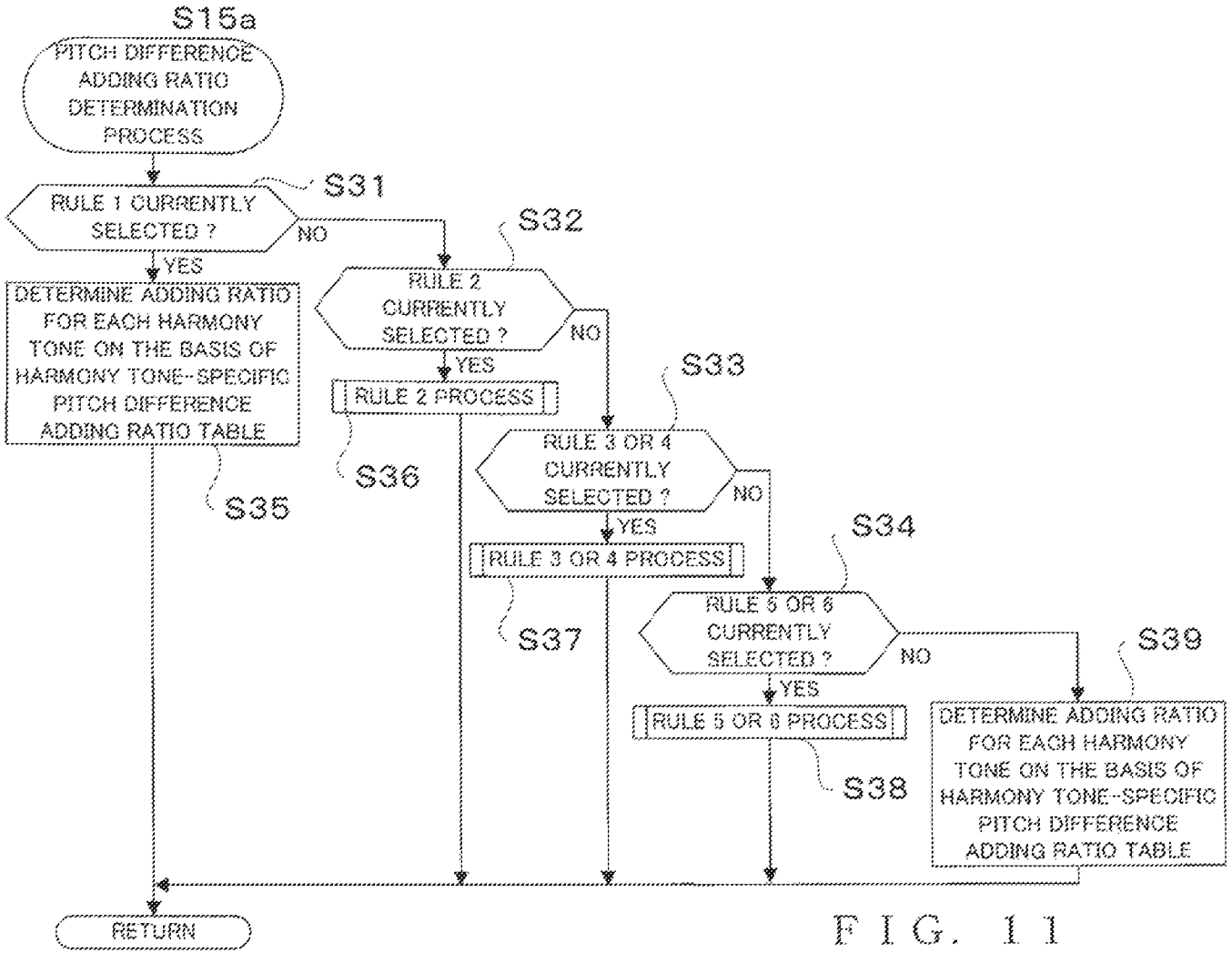
FIG. 11 is a flow chart of a pitch difference adding ratio determination process performed in the second embodiment.

The following describe example details of the pitch difference adding ratio determination process at step S150, with reference to FIG. 11. In the pitch difference adding ratio determination process, as shown in FIG. 11, harmony tones (target pitches) in which pitch difference adding ratios are to be reflected, i.e. harmony tones (target pitches) to be generated reflecting therein pitch difference adding ratios, are identified in accordance with any one of six harmony tone generation rules, i.e. harmony tone generation rule 1 to harmony tone generation rule. Namely, at step S31, stepwise determinations are made, at steps S31 to S34, as to whether harmony tone generation rule 1 is currently selected (step S31), whether harmony tone generation rule 2 is currently selected (step S32), whether harmony tone generation rule 3 or 4 is currently selected (step S33), and whether harmony tone generation rule 5 or 6 is currently selected (step S34). Thus, pitch difference addition ratios are determined in accordance with the harmony tone generation rule having been determined as currently selected.

The harmony tone generation rules, e.g. six harmony tone generation rules employed in the second embodiment, are: harmony tone generation rule 1 which uses the harmony-tone-specific pitch difference adding ratio table in which one or a plurality of pitch difference adding ratios are set in corresponding relation to input tone pitches (normalized pitches) (see FIG. 8A); harmony tone generation rule 2 which uses higher pitch difference adding ratios for harmony tones of higher tone pitches; harmony tone generation rule 3 which uses high pitch difference adding ratios for harmony tones of tone pitches constituting a third (i.e., pitch interval of three diatonic scale degrees); harmony tone generation rule 4 which stabilizes (prevents occurrence of pitch variation of harmony tones of tone pitches constituting a third; harmony tone generation rule 5 which uses a high pitch difference adding ratio for a harmony tone of a tone pitch constituting a tension note relative to an input tone pitch (i.e., normalized pitch); and harmony tone generation rule 6 which stabilizes (prevents occurrence of pitch variation of) a harmony tone of a tone pitch constituting a tension note relative to an input tone pitch. These harmony tone generation rules are prepared for purposes of generating an easy-to-listen harmony tone, a harmony tone presenting a feeling corresponding to a melody or tune (like a major or minor feeling) and a harmony tone with a tense feeling made strong and weak.

Referring back to FIG. 11, if harmony tone generation rule 1 is currently selected (YES determination at step S31), the CPU 1 goes to step S35 to perform a rule 1 process, where it identifies each harmony tone in which a pitch difference adding ratio is to be reflected (hereinafter referred to as "harmony tone to be generated reflecting a pitch difference adding ratio" or "harmony tone to be generated reflecting pitch adjustment information"), for example, in increasing (or decreasing) order of tone pitches and determines a pitch difference adding ratio for each of the thus-determined harmony tones. If harmony tone generation rule 2 is currently selected (NO determination at step S31 and YES determination at step S32), the CPU 1 goes to step S36 to perform a later-described rule 2 process. If harmony tone generation rule 3 or 4 is currently selected (NO determination at each of steps S31 and S32 and YES determination at step S33), the CPU 1 goes to step S37 to perform a later-described rule 3 process or rule 4 process. Further, if harmony tone generation rule 5 or 6 is currently selected (NO determination at each of steps S31 to S33 and YES determination at step S34), the CPU 1 goes to step S38 to perform a later-described rule 5 process or rule 6 process. If it has been determined that neither harmony tone generation rule 5 nor harmony tone generation rule 6 is currently selected (NO determination at each of steps S31 to S35), the CPU 1 determines each harmony tone to be generated reflecting a pitch difference adding ratio, for example, in the increasing (or decreasing) order of tone pitches and determines a pitch difference adding ratio for each of the thus-determined harmony tones, through the rule 1 process based on the pitch difference adding ratio determination table of FIG. 8A (step S39).

Figure 12:
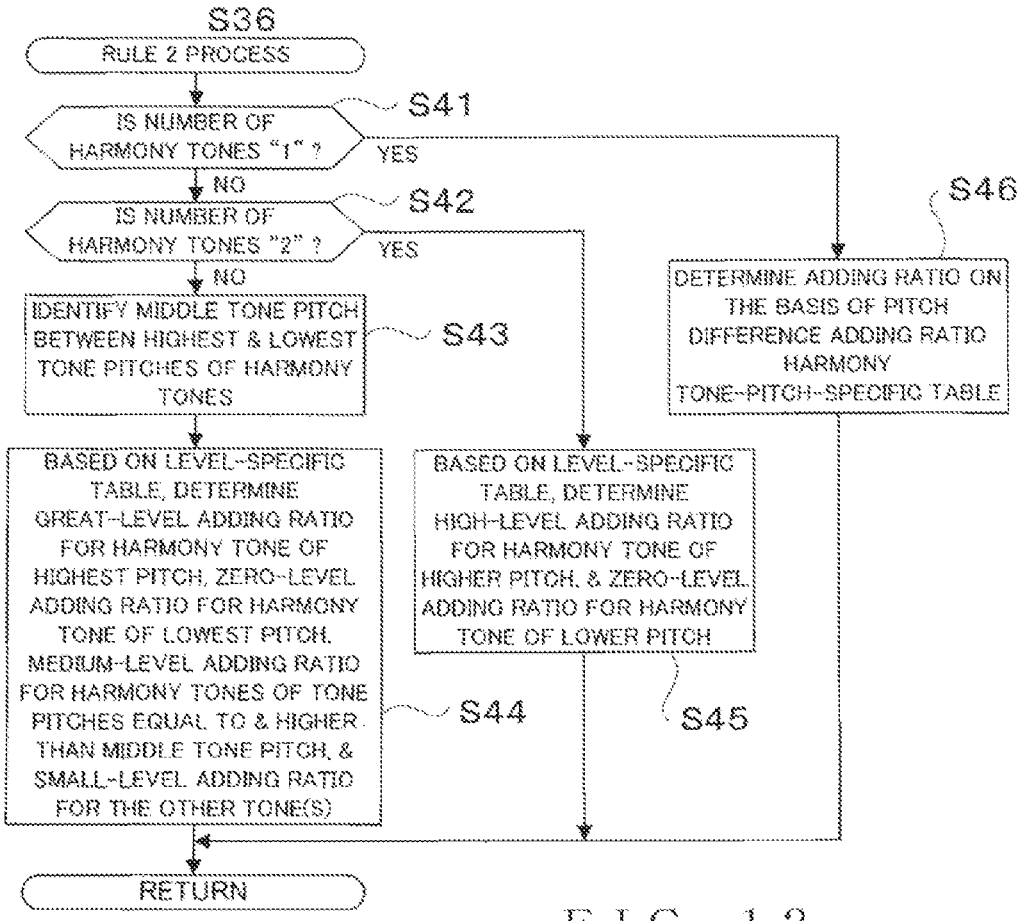
FIG. 12 is a flow chart of a harmony tone generation rule 2 process performed in the second embodiment.

The following describe the rule 2 process (step S36), with reference to FIG. 12. At step S41, a determination is made as to whether the number of harmony tones to be generated is only one. If it has been determined that the number of harmony tones to be generated is only one (YES determination at step S41), the CPU 1 determines the only one harmony tone to be a "harmony tone to be generated reflecting a pitch difference adding ratio", and then determines a pitch difference adding ratio for the identified harmony tone on the basis of the pitch difference adding ratio determination table of FIG. 8A (step S46). If it has been determined that the number of harmony tones to be generated is not only one (NO determination at step S41), a further determination is made, at step S42, as to whether the number of harmony tones to be generated is two. If the number of harmony tones to be generated is two (YES determination at step S42), the CPU 1 determines the two harmony tones to be "harmony tones to be generated reflecting pitch difference adding ratios", and then determines a pitch difference adding ratio for each of the thus-determined harmony tones on the basis of the level-specific pitch difference adding ratio determination table of FIG. 8B ("level-specific table" in FIG. 12) (step S45). In this case, for example, a great-level pitch difference adding ratio is determined for one of the harmony tones which has a higher tone pitch than the other harmony tone, while a zero-level pitch difference adding ratio is determined for the other harmony tone having a lower tone pitch.

Further, if the number of harmony tones to be generated is not two, i.e. the number of harmony tones to be generated is three or more (NO determination at step S42), the CPU 1 goes to step S43, where it identifies a middle tone pitch between the highest tone pitch and lowest tone pitch of the harmony tones to be generated. At nest step S44, the CPU 1 determines all of these harmony tones to be harmony tones to be generated reflecting pitch difference adding ratios, and then determines a pitch difference adding ratio for each of the thus-determined harmony tones on the basis of the level-specific pitch difference adding ratio determination table of FIG. 8B ("level-specific table" in FIG. 12). In this case, for example, a great-level pitch difference adding ratio is determined for one of the harmony tones which has the highest tone pitch, a zero-level pitch difference adding ratio is determined for the harmony tone having the lowest tone pitch, a medium-level pitch difference adding ratio is determined for the harmony tones of tone pitches equal to and higher than the identified middle tone pitch but lower than the highest tone pitch, and a small-level pitch difference adding ratio is determined for the other harmony tone(s).

Figure 13:
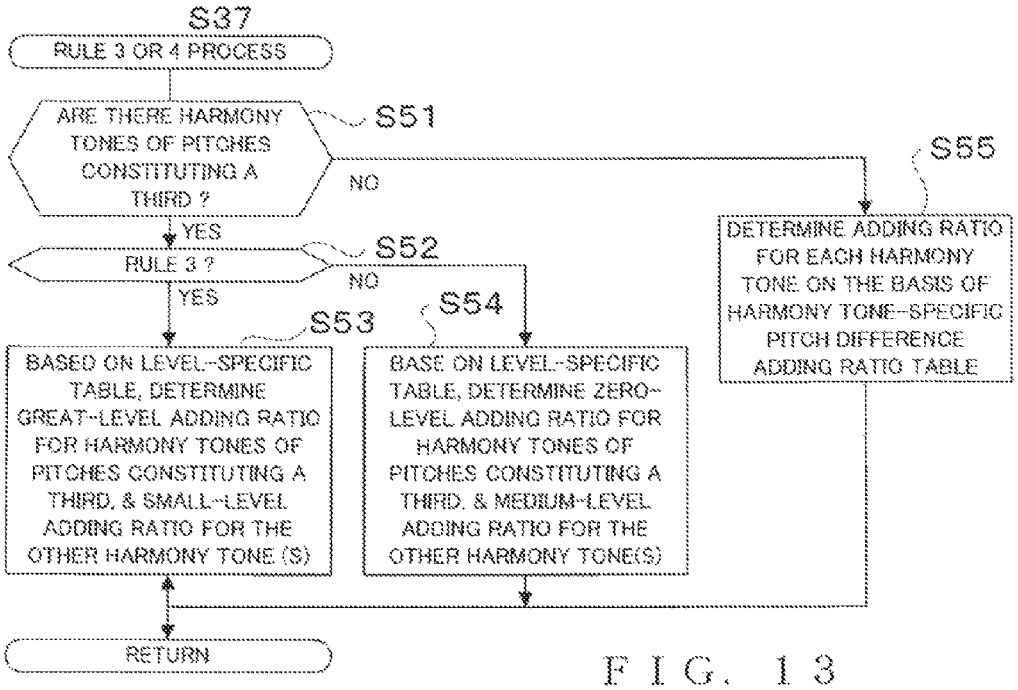
FIG. 13 is a flow chart of a harmony tone generation rule 3 or 4 process performed in the second embodiment.

The following describe the rule 3 or 4 process (step S37), with reference to FIG. 13. At step S51, a determination is made as to whether there are harmony tones of tone pitches constituting a third. If it has been determined that there are not harmony tones of tone pitches constituting a third (NO determination at step S51), the CPU 1 branches to step S55, where it not only identifies each harmony tone to be generated reflecting a pitch difference adding ratio, but also determines a pitch difference adding ratio for each of the thus-determined harmony tones on the basis of the pitch difference adding ratio determination table of FIG. 8A. If it has been determined that there are harmony tones of tone pitches constituting a third (YES determination at step S51), the CPU 1 further determines, at step S52, whether harmony tone generation rule 3 is currently selected. If harmony tone generation rule 3 is currently selected (YES determination at step S52), the CPU 1 determines all of these harmony tones to be "harmony tones to be generated reflecting pitch difference adding ratios", and then determines a pitch difference adding ratio for each of the thus-determined harmony tones on the basis of the level-specific pitch difference adding ratio determination table of FIG. 8B. In this case, for example, a great-level pitch difference adding ratio is determined for each of the harmony tones of the tone pitches constituting a third, and a small-level pitch difference adding ratio is determined for the other harmony tone(s). If harmony tone generation rule 3 is not currently selected, i.e. if harmony tone generation rule 4 is currently selected (NO determination at step S52), the CPU 1 determines all of these harmony tones to be "harmony tones to be generated reflecting pitch difference adding ratios", and then determines a pitch difference adding ratio for each of the thus-determined harmony tones on the basis of the level-specific pitch difference adding ratio determination table of FIG. 8B. In this case, for example, a zero-level pitch difference adding ratio is determined for each of the harmony tones of the tone pitches constituting a third, and a medium-level pitch difference adding ratio is determined for the other harmony tone(s).

Figure 14:
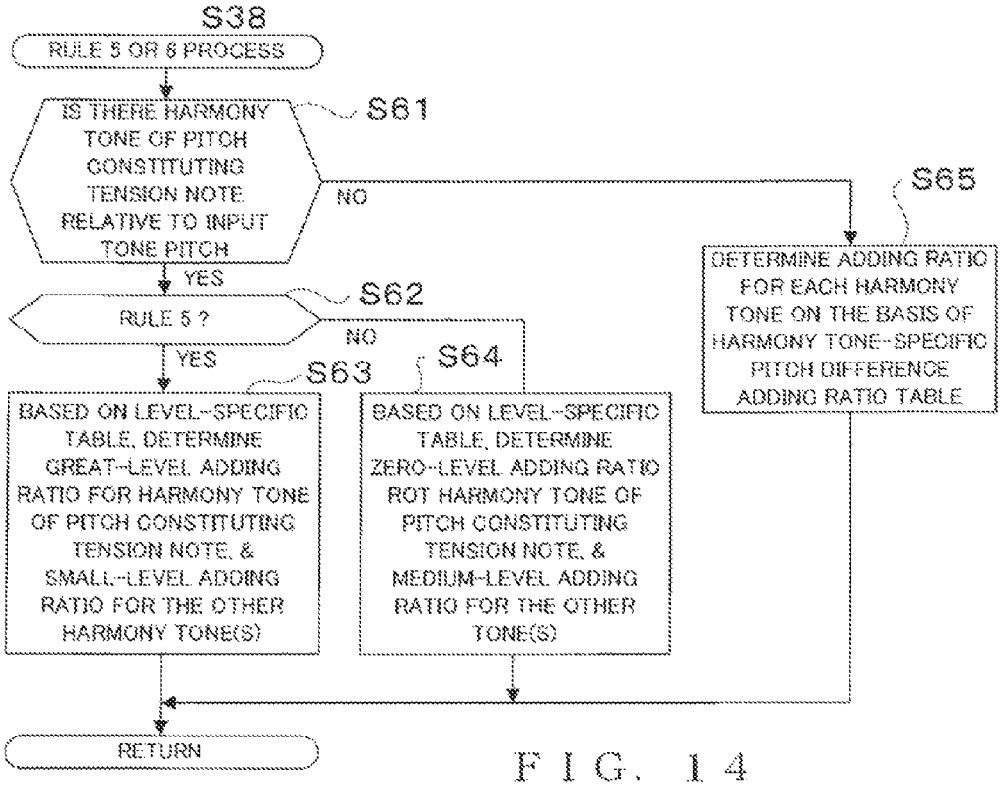
FIG. 14 is a flow chart of a harmony tone generation rule 5 or 6 process performed in the second embodiment.

The following describe the rule 5 or 6 process (step S38), with reference to FIG. 14. At step S61, a determination is made as to whether there is any harmony tone of a tone pitch constituting a tension note relative to the input tone pitch (normalized pitch). If there is no harmony tone of a tone pitch constituting a tension note relative to the input tone pitch (NO determination at step S61), the CPU 1 goes to step S65, where it not only identifies each harmony tone to be generated reflecting a pitch difference adding ratio, but also determines a pitch difference adding ratio for each of the thus-determined harmony tones on the basis of the harmony-tone-specific pitch difference adding ratio determination table of FIG. 8A. If, on the other hand, it has been determined that there is a harmony tone of a tone pitch constituting a tension note relative to the input tone pitch (YES determination at step S61), the CPU 1 proceeds to step S62, where it further determines whether harmony tone generation rule 5 is currently selected.

If it has been determined that harmony tone generation rule 5 is currently selected (YES determination at step S62), at step 63, the CPU 1 determines all of these harmony tones to be "harmony tones to be generated reflecting pitch difference adding ratios", and then determines a pitch difference adding ratio for each of the thus-determined harmony tones on the basis of the level-specific pitch difference adding ratio determination table of FIG. 8B. In this case, for example, a great-level pitch difference adding ratio is determined for the harmony tone of the tone pitch constituting a tension note, and a small-level pitch difference adding ratio is determined for the other harmony tone(s). If harmony tone generation rule 5 is not currently selected, i.e. if harmony tone generation rule 6 is currently selected (NO determination at step S62), the CPU 1 branches to step S64, where it determines all of these harmony tones to be harmony tone to be generated reflecting pitch difference adding ratios, and then determines a pitch difference adding ratio for each of the thus-determined harmony tones on the basis of the level-specific pitch difference adding ratio determination table of FIG. 8B. In this case, for example, a zero-level pitch difference adding ratio is determined for the harmony tone of the tone pitch constituting a tension note, and a medium-level pitch difference adding ratio is determined for the other harmony tone(s).

Steps S16*a* and S17*a* in FIG. 9 are modifications of steps S16 and S17 in FIG. 3. At next step S16*a*, the CPU 1 compares individual ones of the target pitches stored in the note buffer and the input tone pitch stored in the lead tone buffer to thereby determine differences therebetween, and then adds the plurality of pitch differences to the determined difference to thereby calculate a plurality of pitch shift amounts. At step S17*a*, the CPU 1 pitch-shifts the input tone signal on the basis of the calculated pitch shift amounts to thereby generate a plurality of pitch-modulated harmony tone signals, reflecting therein the pitch variation of the input tone signal, on the basis of the target pitches, and then audibly generate's a plurality of harmony tones by reproducing the pitch-modulated harmony tone signals.

Figure 15E:
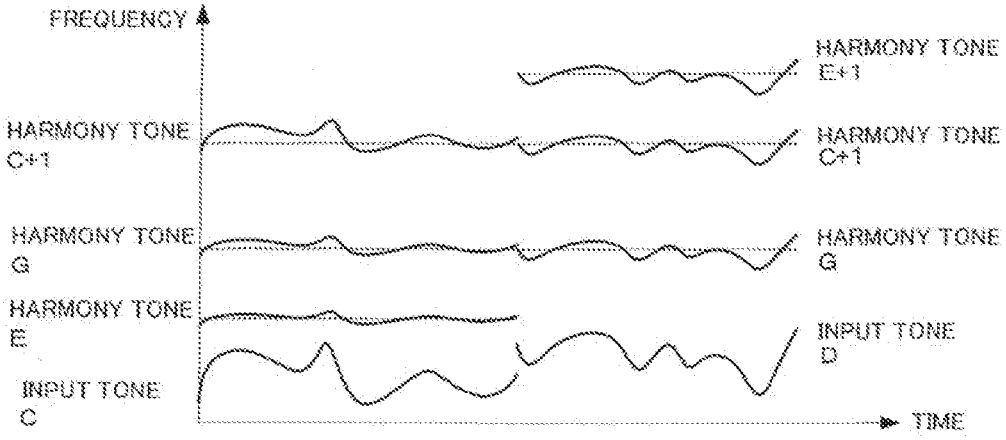

Thus, it is possible to generate a plurality of harmony tone signals that reflect therein the pitch variation of the input tone signal but differ from each other in level of pitch variation as shown in FIG. 15E, by pitch-shifting the input tone signal (more specifically, the stored waveform factor data) for each of the vowel segments on the basis of the pitch shift amounts calculated for the vowel segment.

Whereas a plurality of harmony tone signals of constant pitches, such as "E", "G" and "C+1" or "G", "C+1" and "E+1", are generated in the conventionally-known apparatus as indicated by broken line, the second embodiment of the present invention can generate a plurality of harmony tone signals more or less reflecting therein pitch variation of an input tone signal. Namely, the second embodiment can adjust or increase or decrease, as desired, the level of the pitch variation of the input tone signal by differentiating the level of the pitch difference adding ratio among the individual harmony tone signals. For example, settings may be made in advance such that, if the pitch difference adding ratio is 100%, pitch variation of a harmony tone signal generated presents a same level as pitch variation of an input tone signal, that, as the difference adding ratio is decreased from 100% toward 0%, pitch variation of a harmony tone signal generated presents a smaller level smaller than pitch variation of an input tone signal, and that, if the difference adding ratio is 0%, a harmony tone signal generated presents a constant tone pitch with no pitch variation as in the conventionally known apparatus.

Step S22*a* in FIG. 10 is a modification of step S22 in FIG. 4. At step S22*a*, the CPU 1 references a corresponding one of the harmony tables, stored in the ROM 2 or storage device 8, on the basis of the chord information stored in the chord buffer and the input pitch stored in the lead tone buffer, to determine tone pitches (target pitches) of a plurality of harmony tone signals. At step S150*a* inserted after step 22*a*, a pitch difference adding ratio determination process (FIG. 11) is performed in the same manner as at step S150. Following steps S24*a* and S25*a* are modifications of steps S24 and S25 in FIG. 4 and perform processes same as at step S16*a* and S17*a*.

Note that the pitch adjustment information employed in the present invention is not limited to pitch difference adding ratios (%) determined in advance as in the above-described embodiments; pitch difference adding ratios (%) may be calculated as the pitch adjustment information through arithmetic operations. In such a case, a plurality of pitch difference adding ratio calculation rules may be prepared in advance so that any one of the pitch difference adding ratio calculation rules can be selected. Furthermore, the present invention may be constructed to allow the user to edit the calculated pitch difference adding ratios or pitch adjustment information. Furthermore, the present invention may be constructed to automatically detect a level of pitch variation of an input tone signal and determine pitch adjustment information for each harmony tone in accordance with the detected pitch variation. Moreover, the present invention may be constructed to allow the user to designate each harmony tone to be generated reflecting a pitch difference adding ratio, i.e. to be subjected to pitch adjustment based on the pitch adjustment information.

Furthermore, the present invention may be constructed to designate in advance the number of harmony tones to be generated. The above-described embodiment is constructed to determine tone pitches for generating three harmony tones on the basis of one of the harmony tables (see FIGS. 7A and 713) designated in accordance with chord information. Alternatively, when two tones are designated as tones to be generated, two lower tone pitches, two higher tone pitches or the like of three tone pitches defined in the harmony table having been designated or selected in accordance with the major chord type or minor chord type of the chord information may be determined as target pitches.

Note that a plurality of difference pitch adding ratio tables of a same type, i.e. a plurality of harmony-tone-specific pitch difference adding ratio tables or a plurality of level-specific pitch difference adding ratio tables may be prepared so that any one of the difference pitch adding ratio tables can be switchably used; switching between the difference pitch adding ratio tables of the same type may be made as necessary during the course of a music piece performance.

Note that, in the case where the level-specific pitch difference adding ratio table (FIG. 8B) is used and if a plurality of harmony tones of a same level are to be generated, the pitch difference adding ratio to be applied may be adjusted to slightly different values (e.g., differing from each other by 2 (two)) rather than a same value.

This application is based on, and claims priorities to, JP PA 2010-040068 filed on 25 Feb. 2010 and JP PA 2011-028622 filed on 14 Feb. 2011. The disclosure of the priority applications, in its entirety, including the drawings, claims, and the specification thereof, are incorporated herein by reference.

What is claimed is:

1. A tone signal generation apparatus comprising:

an input section that inputs a tone signal;

a processor; and a memory device storing computer instructions configured to instruct the processor to execute:

a pitch detection task that sequentially detects a specific pitch of the tone signal input via said input section and detects, from the specific pitch, a normalized pitch corresponding to any one of musical pitch names;

a difference generation task that obtains difference information pertaining to a difference between the specific pitch and the normalized pitch; and a target pitch determination task that determines, as a target pitch of a tone signal to be generated, a pitch having a given pitch interval from the normalized pitch; and a tone generator that generates a tone signal having a pitch obtained by modulating the target pitch in accordance with the difference information.

2. The tone signal generation apparatus as claimed in claim 1, wherein said tone generator generates pitch information indicative of the pitch obtained by modulating the target pitch in accordance with the difference information and generates the tone signal on the basis of the generated pitch information.

3. The tone signal generation apparatus as claimed in claim 2, wherein the pitch information indicates a pitch shift amount from the normalized pitch.

4. The tone signal generation apparatus as claimed in claim 1, wherein said tone generator generates a tone signal having the target pitch and modulates the generated tone signal having the target pitch in accordance with the difference information, to thereby generate the tone signal having the pitch obtained by modulating the target pitch in accordance with the difference information.

5. The tone signal generation apparatus as claimed in claim 1, wherein:

said target pitch determination task determines a plurality of target pitches having mutually-different pitch intervals from the normalized pitch, and said tone generator generates the tone signals in association with individual ones of the plurality of target pitches.

6. The tone signal generation apparatus as claimed in claim 5, wherein, for each of the tone signals associated with the individual ones of the plurality of target pitches, a modulation degree with which the target pitch is modulated in accordance with the difference information is adjustable independently of other of the tone signals.

7. The tone signal generation apparatus as claimed in claim 1, wherein the stored computer instructions are further configured to instruct the processor to execute an adjustment task that variably adjusts a modulation degree with which the target pitch is modulated in accordance with the difference information.

8. The tone signal generation apparatus as claimed in claim 1, wherein a difference between the specific pitch indicated by the difference information and the normalized pitch is less than 100 cents.

9. The tone signal generation apparatus as claimed in claim 1, wherein a pitch difference, from the target pitch, of the tone signal generated by said tone signal generation task is controlled to be limited to less than 100 cents.

10. The tone signal generation apparatus as claimed in claim 1, wherein said tone generator generates the tone signal using, as a tone source waveform, a waveform based on the input tone signal.

11. The tone signal generation apparatus as claimed in claim 1, wherein the function of the tone generator is executed by the stored computer instructions configured to instruct the processor to execute a tone signal generation task that executes the function of the tone generator.

12. A computer-implemented method of generating a tone signal, the method comprising:

a step of inputting a tone signal;

a step of sequentially detecting a specific pitch of the input tone signal and detecting, from the specific pitch, a normalized pitch corresponding to any one of musical pitch names;

a step of obtaining difference information pertaining to a difference between the specific pitch and the normalized pitch;

a step of determining, as a target pitch of a tone signal to be generated, a pitch having a given pitch interval from the normalized pitch; and a step of generating a tone signal having a pitch obtained by modulating the target pitch in accordance with the difference information.

13. A non-transitory computer-readable storage medium storing a program executable by a processor to perform a method of generating a tone signal, said method comprising:

a step of inputting a tone signal;

a step of sequentially detecting a specific pitch of the input tone signal and detecting, from the specific pitch, a normalized pitch corresponding to any one of musical pitch names;

a step of obtaining difference information pertaining to a difference between the specific pitch and the normalized pitch;

a step of determining, as a target pitch of a tone signal to be generated, a pitch having a given pitch interval from the normalized pitch; and a step of generating a tone signal having a pitch obtained by modulating the target pitch in accordance with the difference information.

14. A tone signal generation apparatus comprising:

an input section that inputs a tone signal;

a processor; and a memory device storing computer instructions configured to instruct the processor to execute:

a pitch detection task that sequentially detects a specific pitch of the tone signal input via said input section and detects, from the specific pitch, a normalized pitch corresponding to any one of musical pitch names;

a difference generation task that obtains difference information pertaining to a difference between the specific pitch and the normalized pitch;

a target pitch determination task that determines, as a plurality of target pitches of tone signals to be generated, a plurality of pitches having mutually different pitch intervals from the normalized pitch;

a pitch difference adjustment task that obtains pitch adjustment information for adjusting the difference between the specific pitch and the normalized pitch of the difference information to thereby provide changed difference information; and a tone signal generation task that identifies a target pitch, in which the difference adjustment information is to be reflected, from among the plurality of target pitches and generates a tone signal having a pitch obtained by modulating the identified target pitch in accordance with the changed difference information having the difference between the specific pitch and the normalized pitch of the difference information adjusted on the basis of the pitch adjustment information.

15. The tone signal generation apparatus as claimed in claim 14, wherein said tone signal generation task generates pitch information indicative of the pitch obtained by modulating the target pitch in accordance with the changed difference information and generates the tone signal on the basis of the generated pitch information.

16. The tone signal generation apparatus as claimed in claim 15, wherein the pitch information indicates a pitch shift amount from the normalized pitch.

17. The tone signal generation apparatus as claimed in claim 14, wherein said tone signal generation task generates a tone signal having the target pitch and modulates the generated tone signal having the target pitch in accordance with the changed difference information, to thereby generate the tone signal having the pitch obtained by modulating the target pitch in accordance with the changed difference information.

18. The tone signal generation apparatus as claimed in claim 14, wherein the stored computer instructions are further configured to instruct the processor to execute a setting task that sets an adjustment amount, by the pitch adjustment information, of the difference between the specific pitch and the normalized pitch of the difference information.

19. The tone signal generation apparatus as claimed in claim 14, wherein a difference between the specific pitch indicated by the changed difference information and the normalized pitch is less than 100 cents.

20. The tone signal generation apparatus as claimed in claim 14, wherein a pitch difference, from the target pitch, of the tone signal generated by said tone signal generation task is controlled to be limited to less than 100 cents.

21. The tone signal generation apparatus as claimed in claim 14, wherein said tone signal generation task generates the tone signal using, as a tone source waveform, a waveform based on the input tone signal.

22. The tone signal generation apparatus as claimed in claim 14, further comprising a tone generator that generates a tone signal having the specific pitch on the basis of the input tone signal.

23. A computer-implemented method of generating a tone signal, the method comprising:

a step of inputting a tone signal;

a step of sequentially detecting a specific pitch of the input tone signal and detecting, from the specific pitch, a normalized pitch corresponding to any one of musical pitch names;

a step of obtaining difference information pertaining to a difference between the specific pitch and the normalized pitch;

a step of determining, as a plurality of target pitches of tone signals to be generated, a plurality of pitches having mutually different pitch intervals from the normalized pitch;

a step of obtaining pitch adjustment information for adjusting the difference between the specific pitch and the normalized pitch of the difference information to thereby provide changed difference information; and a step of identifying a target pitch, in which the pitch adjustment information is to be reflected, from among the plurality of target pitches and generating a tone signal having a pitch obtained by modulating the identified target pitch in accordance with the changed difference information having the difference between the specific pitch and the normalized pitch of the difference information adjusted on the basis of the pitch adjustment information.

24. A non-transitory computer-readable storage medium storing a program executable by a processor to perform a method of generating a tone signal, said method comprising:

a step of inputting a tone signal;

a step of sequentially detecting a specific pitch of the input tone signal and detecting, from the specific pitch, a normalized pitch corresponding to any one of musical pitch names;

a step of obtaining difference information pertaining to a difference between the specific pitch and the normalized pitch;

a step of determining, as a plurality of target pitches of tone signals to be generated, a plurality of pitches having mutually different pitch intervals from the normalized pitch;

a step of obtaining pitch adjustment information for adjusting the difference between the specific pitch and the normalized pitch of the difference information to thereby provide changed difference information; and a step of identifying a target pitch, in which the pitch adjustment information is to be reflected, from among the plurality of target pitches and generating a tone signal having a pitch obtained by modulating the identified target pitch in accordance with the changed difference information having the difference between the specific pitch and the normalized pitch of the difference information adjusted on the basis of the pitch adjustment information.

* * * * *